US005475193A

United States Patent [19]

Perdoncin

[11] Patent Number: 5,475,193

[45] Date of Patent: Dec. 12, 1995

[54] ARC QUENCHING CHAMBER INCLUDING GAS GENERATING STATIONARY CONTACT INSULATION AND IMPROVED ARC RUNNER

[75] Inventor: Francesco Perdoncin, Villa de Serio, Italy

[73] Assignee: ABB SACE SpA, Bergamo, Italy

[21] Appl. No.: 230,918

[22] Filed: Apr. 21, 1994

[30] Foreign Application Priority Data

Apr. 21, 1993 [IT] Italy ..... MI93A0789

[51] Int. Cl.[6] ..... H01H 9/30; H01H 33/04

[52] U.S. Cl. ..... 218/34; 218/36; 218/40; 218/146; 218/147; 218/156

[58] Field of Search ..... 200/144 R, 144 A, 200/144 C, 144 AP, 146 R, 146 A, 146 AA, 147 R, 147 A, 147 B, 148 R, 148 C, 149 R, 149 A, 151, 237–292; 335/195–204, 16; 218/15, 16, 30, 31, 32, 33, 34, 36, 37, 38, 40, 146, 147, 148, 149, 150, 151, 153, 156

[56] References Cited

U.S. PATENT DOCUMENTS

| | | | |
|---|---|---|---|
| 2,467,937 | 4/1949 | Jackson | 218/36 |
| 3,818,165 | 6/1974 | Zavitsanos et al. | 200/144 C |
| 4,158,827 | 6/1979 | Bratkowski et al. | 335/195 X |
| 4,654,490 | 3/1987 | Leone et al. | 218/33 |
| 4,654,491 | 3/1987 | Maier et al. | 200/147 R |
| 5,206,614 | 4/1993 | Carothers | 335/16 |
| 5,268,661 | 12/1993 | Grunert et al. | 200/147 R X |

FOREIGN PATENT DOCUMENTS

| | | | |
|---|---|---|---|
| 3729504 | 3/1988 | Germany | H01H 9/30 |

*Primary Examiner*—J. R. Scott
*Attorney, Agent, or Firm*—Burns, Doane, Swecker & Mathis

[57] ABSTRACT

The low-voltage switch includes a stationary contact (2) and a moving contact (3). The two contacts and an arc splitter stack (6) are arranged in an arc quenching chamber (5). An elongation element (14) is fitted on the stationary contact (2), extends in the direction of the arc splitter stack (6) and is used for accommodating an arc root. A section, which is constructed in the form of a plate, of a power supply lead of the stationary contact (2) is widened in a U-shape. The two limbs (11) of the U are bridged by a yoke (12) at their free ends. A conductor element is fitted on the yoke (12), which conductor element is in the form of a plate, is formed by a contact tongue (13) of the stationary contact (2) and by an elongation element (14) fastened thereto, and is inclined in the direction of the arc splitter stack (6) with respect to the plate-shaped section of the power supply lead. Arranged in the arc quenching chamber (5) is an insulating element (15) which is provided with an opening (16), shields the plate-shaped section of the power supply lead of the stationary contact (2) with respect to the arc quenching chamber (5) and through whose opening (16) the plate-shaped conductor element is passed.

This switch is distinguished by low contact erosion and low wear of the arc quenching chamber (5), while having a high switching power. This is dependent on the fact that quenching gas which emerges from the insulating part under the influence of an arc flows deliberately in the direction of the arc splitter stack (6), and that the root of the switching arc, which root originates on the stationary contact (2), is guided particularly rapidly into the arc splitter stack by this gas flow and by the force of the magnetic field of the current which is to be disconnected.

7 Claims, 2 Drawing Sheets

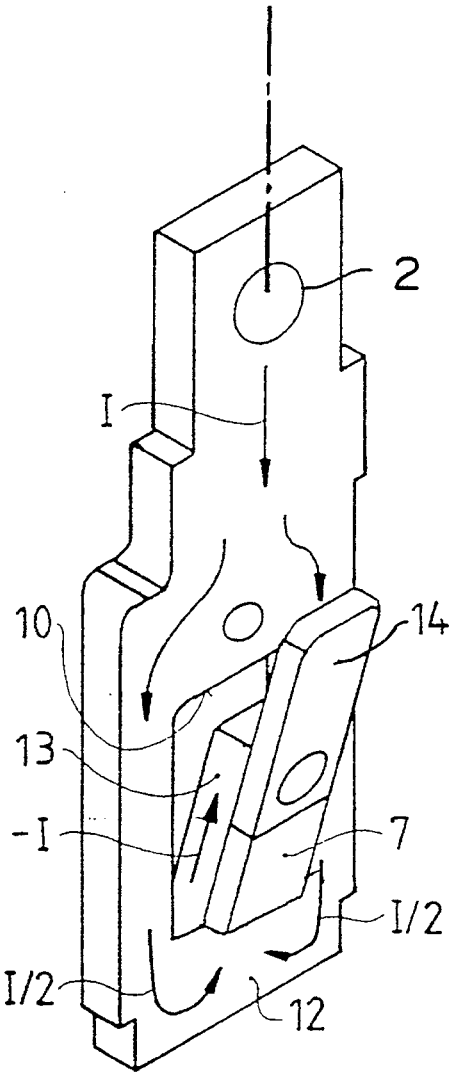
FIG. 3
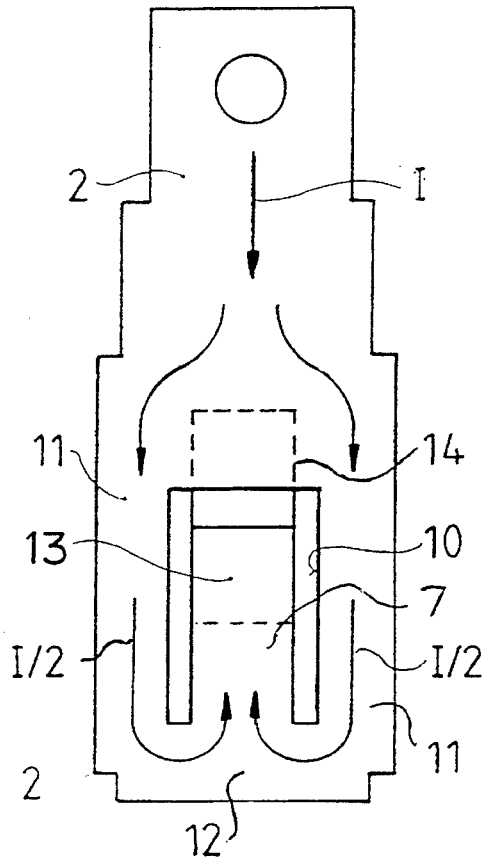
FIG 2
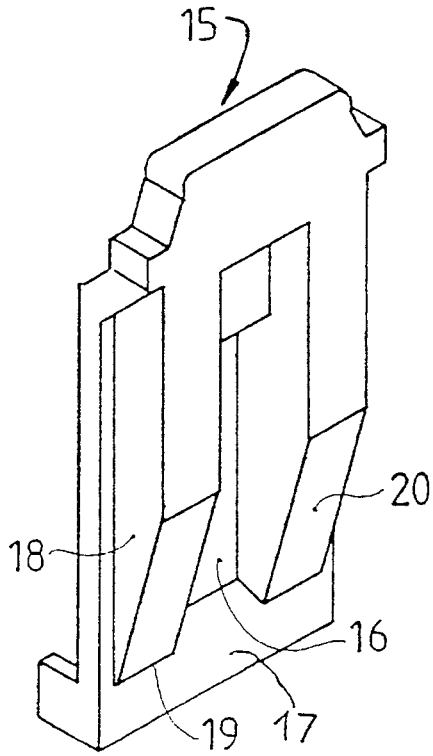

ARC QUENCHING CHAMBER INCLUDING GAS GENERATING STATIONARY CONTACT INSULATION AND IMPROVED ARC RUNNER

BACKGROUND OF THE INVENTION

1. Field of the Invention

The invention is based on a low-voltage switch having a stationary contact and a moving contact and having an arc quenching chamber which accommodates the two contacts as well as an arc splitter stack, and in the case of which an elongation element is fitted on the stationary contact, which elongation element extends in the direction of the arc splitter stack, is used for accommodating an arc root and interacts with an insulating part.

2. Discussion of Background

A switch of the type mentioned initially is described, for example, in DE 37 29 504 A1. This switch has a stationary contact with a power supply lead which is bent in a U-shape and whose end which supports a stationary contact element and is guided into an arc quenching chamber has an elongation element, which extends to an arc splitter stack, for accommodating a root of a switching arc. The power supply lead is partially covered with insulating material. This results in the switching arc running on the elongation element more easily and at the same time being quenched quicker.

SUMMARY OF THE INVENTION

Accordingly, one object of the invention is to increase the switching power in the case of a switch of the type mentioned initially.

The switch according to the invention is distinguished by low contact erosion and low wear of the quenching chamber, while having a high switching power. This is achieved in that quenching gas which emerges from the insulating part under the influence of an arc flows deliberately in the direction of the arc splitter stack, and in that the root of the switching arc, which root originates on the stationary contact, is guided particularly rapidly into the arc splitter stack by this gas flow and by the force of the magnetic field of the current which is to be disconnected.

As a result of the rapid displacement of the arc root and because of the fast growth of the arc, particularly large currents can be interrupted. Since the majority of the magnetic field which is used for magnetic blowing of the switching arc is formed in turn sections of the power supply lead of the stationary contact, which sections are arranged transversely with respect to the movement direction of the moving contact, the volume of the arc quenching chamber and the movement of the moving contact can be increased by up to 50% for given external dimensions of the switch.

BRIEF DESCRIPTION OF THE DRAWINGS

A more complete appreciation of the invention and many of the attendant advantages thereof will be readily obtained as the same becomes better understood by reference to the following detailed description When considered in connection with the accompanying drawings, wherein:

FIG. 2 shows a side view of a stationary one of the contacts of the switch according to FIG. 1 on the left, and FIG. 3 shows a perspective view of the stationary contact according to FIG. 2 and of an insulating part interacting with it, before the assembly of the switch.

DESCRIPTION OF THE PREFERRED EMBODIMENTS

Figure 1:
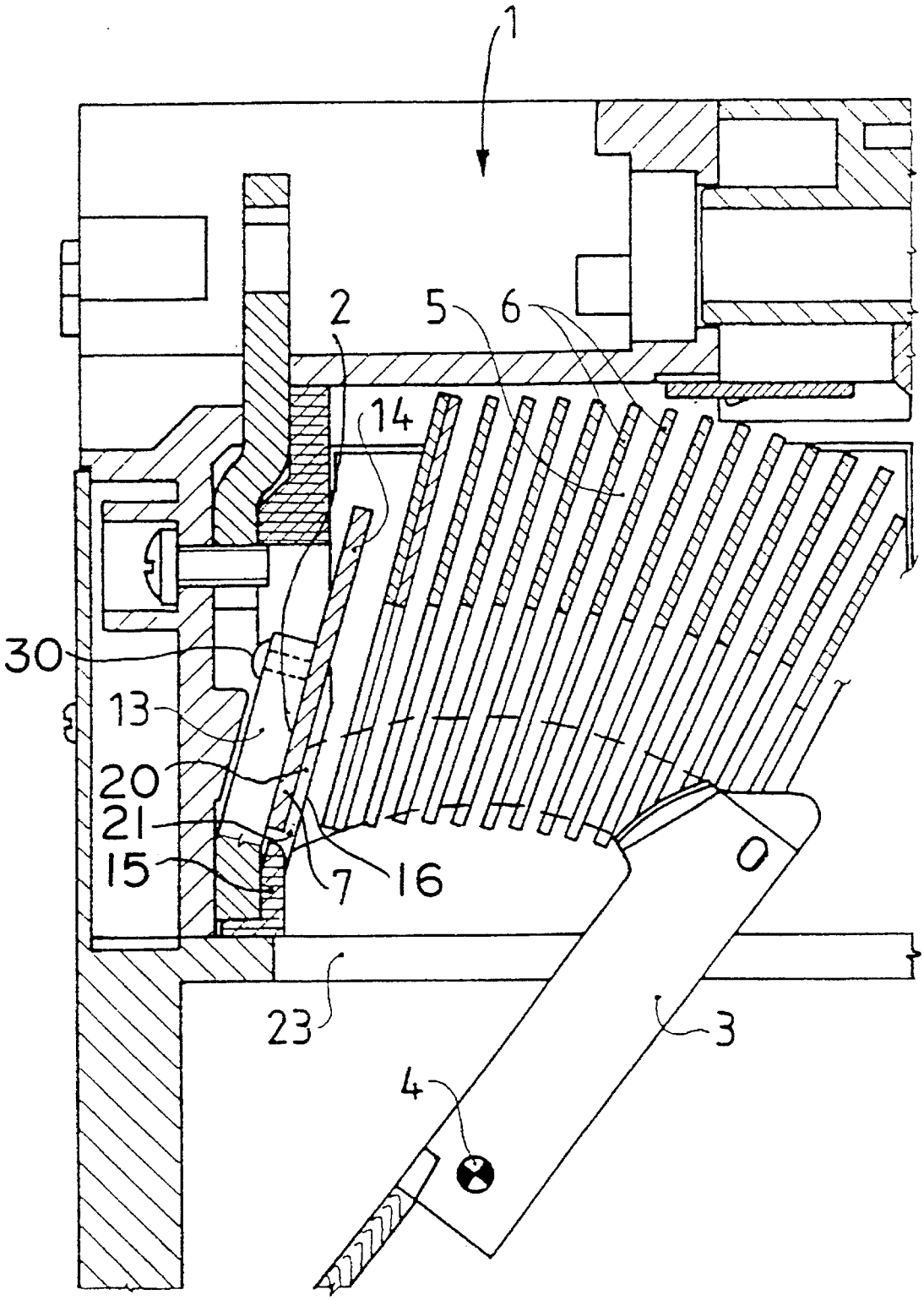
FIG. 1 shows a plan view of a part of a pole of a switch which is designed according to the invention, in a sectional view along the movement direction of one of its moving contacts.

Referring now to the drawings, wherein like reference numerals designate identical or corresponding parts throughout the several views, the multipole switch which is illustrated in FIG. 1 has a housing 1 made of insulating material. The housing 1 comprises—separated for each pole—a stationary contact 2, which is constructed predominantly in the form of a plate, as well as a moving contact 3 which can pivot about a stationary axis 4 and is connected to a flexible electrical power connection. The two contacts 2, 3 are passed into an arc quenching chamber 5 which includes an arc splitter stack 6. A recess 23, which is provided in the housing 1, enables a pivoting movement of the moving contact 3. In order to allow as little gas as possible to escape from the arc quenching chamber 5 during a switching process, the size of the recess 23 is advantageously selected such that it is scarcely any larger than the thickness of the moving contact 3.

The stationary contact 2, which can be seen in more detail in FIGS. 2 and 3, has a power supply lead with an opening 10 which is bounded by a yoke 12 and by two limbs 11 which extend parallel to one another and are dimensioned to be the same size. The current I supplied is split at the opening 10. Half the current I/2 thus flows through each limb 11. The two currents I/2 are joined together again in the yoke 12. The yoke 12 continues in a contact tongue 13 which is directed into the arc quenching chamber 5 is slightly inclined—typically by approximately 10° to 30°—with respect to the plate-shaped stationary contact.

In this way, the currents in the limbs 11 and in the contact tongue 13 run virtually in opposite (indicated by arrows) directions. The opening 10 results in two turns in the power supply lead of the stationary contact 2. The magnetic field produced by the current I/2 flowing in these turns acts on an elongation element 14, which is connected on the arc quenching chamber side to the contact tongue 13 in an electrically conductive manner, for example by riveting (for example, rivet 30, as illustrated in FIG. 1) and/or soldering, extends the contact tongue 13 in the direction of the arc splitter stack 6 and forms a plate-shaped conductor element together with the contact tongue 13. The elongation element 14 is constructed as a contact element 7 on the fitting of the contact tongue 13 on the yoke 12. When the switch is in the switched-on position, this contact element 7 makes contact with a contact element, which is not shown, of the moving contact 3.

An insulating part 15, made of a material, preferably such as polytetrafluoroethylene, polyamide or polyoxymethylene, which emits quenching gas under the influence of an arc, forms a side wall of the arc quenching chamber 5, which side wall shields the power supply lead of the stationary contact 2 with respect to the thermal effect of a switching arc. The insulating part 15 has an opening 16 through which that conductor element is passed which is formed by the contact tongue 13 and the elongation element 14. The lateral boundary surfaces of the opening 16 rest on the narrow side surfaces of the contact tongue 13 and thus make it difficult for the gas to pass out of the arc quenching chamber 5.

The insulating part 15 has two wedge-shaped tabs 18 on the arc quenching chamber side. The tips 19 of the tabs 18 are fitted in the region of the contact element 7. A section 20 of the tab rear which is fitted on the tip 19 of each tab 18 rises at an angle corresponding to the inclination of the contact tongue 13. Above the contact element 7, in the end section of the elongation element 14, the tab rear has a section which is constructed parallel to the plate-shaped part of the stationary contact 2 and whose distance from that part of the elongation element 14 which is guided through the opening 16 increases upwards. The two sections 20 of the tabs 18 and a part 17 of the insulating part 15, which part 17 connects the two tabs at their tips 19, considerably overhang the contact element 7 and a section of the elongation element 14 connected to the contact element 7, and thus form a groove-shaped depression 21 whose base is formed by the contact element 7 and the section of the elongation element 14 connected thereto FIG. 1).

The method of operation of the switch according to the invention is now as follows:

In the switched-on state, the current I flows in a current path which passes from the power supply lead of the stationary contact 2, by means of the two limbs 11 and the contact tongue 13, via the contact element 7 and the moving contact 3, to the flexible electrical power connection of the moving contact. In this case, the current I is divided at the opening 10 in the two limbs 11, which are fitted in a U-shape, into two currents of half the magnitude I/2, flowing parallel to one another. The two currents I/2 are joined together again in the yoke 12 and are passed to the contact element 7 in the contact tongue 13 as a current −I in virtually the opposite direction to the current I running in the plate-shaped part of the power supply lead. Each of the two limbs 11 is in each case part of one of two turns which are provided in the power supply lead to the contact element 7 and in which the contact tongue 13 is also included. In this region, the contact tongue 13 with the contact element 7 and the moving contact 3 form an upwardly extending loop in this current path.

During switching off, the moving contact 3 is pivoted to the right into the position indicated in FIG. 1 and forms an arc whose root is on the contact element 7 and the contact element, which is not shown, of the moving contact 3. The pivoting movement is in this case assisted by the magnetic field of the current to be disconnected, which current widens the loop formed by the contact tongue 13, the arc and the moving contact 3 and at the same time guides the moving contact 3 to the right. At the same time, the magnetic field of the current flowing in the loop forces the arc onto the arc splitter stack 6.

The root, burning on the contact element 7, of the arc at the same time powerfully heats the surrounding material of the insulating part 15 in the region of the tabs 18 and of the connecting part 17, as a result of which this material emits quenching gas. Since the root and a part of the arc which is fitted on the root are virtually surrounded by insulating material, the arc emits a large portion of its energy to the insulating material. Relatively large quantities of quenching gas are thus formed from the insulating part 15 even in the case of small currents. At the same time, it is ensured that this quenching gas has a preferred flow direction which is directed towards the arc splitter stack 6 and forces the root, which originates on the contact element 7, of the arc into the elongation element 14.

The magnetic field of the current flowing through the two turns which are provided in the power supply lead of the stationary contact 2 exerts a third force on the arc. This field assists the quenching gas flow during the displacement of the arc root from the contact element 7 onto the elongation element 14. As a result of the common effect of these forces, the arc is guided very quickly and reliably into the arc splitter stack 6 and is quenched there. At the same time, the quenching gas which is emitted from the insulating part 15 ensures that the quenching paths which are bounded by the arc splitter plates are free of ionized particles so that the quenching paths regain their dielectric strength very quickly and obviate undesired restriking, even when switching large currents in the kA range. In this case, it is at the same time particularly advantageous that contact erosion and wear of the arc quenching chamber 6 are drastically reduced.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. Low voltage switch comprising:

an arc quenching chamber;

an arc splitting stack included in said quenching chamber;

a stationary contact passed into said arc quenching chamber and having a plate-shaped section which is widened in a U-shape with two limbs of the U-shape being bridged by a yoke at free ends of the two limbs, a contact tongue fitted onto the yoke, being inclined toward said arc splitter stack with respect to said plate-shaped section and supporting a contact element and an elongation element;

a movable contact which is movable into said arc quenching chamber for cooperation with the contact element of said stationary contact;

an insulating part forming a side wall of said arc quenching chamber and shielding said plate-shaped section of said stationary contact with respect to said arc quenching chamber, said insulating part having an rectangular-shaped opening with lateral boundary surfaces through which opening said contact tongue and said elongation element are passed such that the lateral boundary surfaces rest on narrow side surfaces of said contact tongue; and a groove-shaped depression arranged in said arc quenching chamber which depression is formed from said insulating part and said stationary contact and in whose base said contact element of said stationary contact is arranged.

2. The switch as claimed in claim 1, wherein the depression is bounded laterally by two tabs of the insulating part, which are extended in the direction of the arc splitter stack and each have a first section with a tab rear which is arranged parallel to the elongation element.

3. The switch as claimed in claim 2, wherein the tabs each have a second section, which is connected to the first section, is extended parallel to the plate-shaped section of the power supply lead of the stationary contact and in whose region the elongation element is guided out of the insulating part.

4. A switch comprising:

an arc quenching chamber;

an arc splitting stack included in said quenching chamber;

a first contact located in said arc quenching chamber and having a U-shaped plate with two limbs, the two limbs of the U-shaped plate being bridged by a yoke at free ends of the two limbs;

a contact tongue located on the yoke, said contact tongue being inclined toward said arc splitter stack with respect to said U-shaped plate and supporting a contact element and an elongation element;

a second contact located in said quenching chamber for cooperating with the contact element of said first contact;

an insulating part of said arc quenching chamber for shielding said first contact with respect to said arc quenching chamber, said insulating part having an opening with lateral boundary surfaces through which opening said contact tongue and said elongation element are passed such that the lateral boundary surfaces face side surfaces of said contact tongue; and a groove-shaped depression arranged in said arc quenching chamber, said depression being formed from said insulating part and said first contact, said contact element of said first contact being arranged in said groove-shaped depression.

5. The switch as claimed in claim 4, wherein the depression is bounded laterally by two tabs of the insulating part which extend toward the arc splitter stack, each of said two tabs having a first section with a tab rear which is arranged parallel to the elongation element.

6. The switch as claimed in claim 5, wherein the two tabs each have a second section, which is connected to the first section, is extended parallel to the U-shaped plate of the first contact and in whose region the elongation element is guided out of the insulating part.

7. A switch as claimed in claim 6, wherein said first contact is stationary within said arc quenching chamber and said second contact is movable within said arc quenching chamber.

* * * * *